US009314906B2

(12) United States Patent
Nelson

(10) Patent No.: US 9,314,906 B2
(45) Date of Patent: Apr. 19, 2016

(54) SOCKET

(71) Applicant: Techtronic Power Tools Technology Limited, Tortola (VG)

(72) Inventor: Daniel B. Nelson, Anderson, SC (US)

(73) Assignee: TECHTRONIC POWER TOOLS TECHNOLOGY LIMITED, Tortola (VG)

( * ) Notice: Subject to any disclaimer, the term of this patent is extended or adjusted under 35 U.S.C. 154(b) by 335 days.

(21) Appl. No.: 13/788,142

(22) Filed: Mar. 7, 2013

(65) Prior Publication Data

US 2013/0233133 A1 Sep. 12, 2013

Related U.S. Application Data

(60) Provisional application No. 61/609,445, filed on Mar. 12, 2012.

(51) Int. Cl.
*B25B 13/06* (2006.01)

(52) U.S. Cl.
CPC ..... *B25B 13/06* (2013.01)

(58) Field of Classification Search
CPC ..... B25B 13/06
USPC ..... 81/121.1, 124.2, 125; D8/29
See application file for complete search history.

(56) References Cited

U.S. PATENT DOCUMENTS

| | | | | | |
|---|---|---|---|---|---|
| 1,395,528 | A | | 11/1921 | Silva | |
| 1,471,451 | A | | 10/1923 | Crimp | |
| 1,585,338 | A | * | 5/1926 | Fisher | B25B 23/065 81/125 |
| 1,626,730 | A | * | 5/1927 | Haynes | 81/185 |
| 2,239,548 | A | | 4/1941 | Butler et al. | |
| 2,503,364 | A | | 4/1950 | Viets | |
| 2,697,958 | A | | 12/1954 | Kozakewich | |
| 2,805,594 | A | | 9/1957 | Fogel | |
| 4,482,131 | A | * | 11/1984 | Hamilton | B25C 11/00 254/18 |
| 5,327,801 | A | * | 7/1994 | Andreasen | B25B 13/48 81/125 |
| 5,347,892 | A | * | 9/1994 | Moetteli | 81/177.85 |
| 5,551,321 | A | * | 9/1996 | Bottiglieri | 81/125 |
| 5,607,250 | A | | 3/1997 | Tatterson et al. | |
| D411,723 | S | * | 6/1999 | Lamerrill | D8/29 |
| 5,927,160 | A | | 7/1999 | Hsieh | |
| 6,023,999 | A | | 2/2000 | Cho | |
| 6,047,618 | A | | 4/2000 | Pieri | |
| 6,073,522 | A | | 6/2000 | Carnesi | |
| 6,557,727 | B1 | * | 5/2003 | Robertson | 221/278 |
| 6,761,093 | B2 | | 7/2004 | Chang | |
| 6,880,432 | B2 | | 4/2005 | Hsieh | |
| 6,951,156 | B2 | | 10/2005 | Garg | |
| 7,290,467 | B2 | | 11/2007 | Harker | |
| 7,311,022 | B2 | | 12/2007 | Putney et al. | |
| 7,437,975 | B1 | | 10/2008 | De Anfrasio | |
| D584,933 | S | * | 1/2009 | Jergenson | D8/29 |
| D596,003 | S | * | 7/2009 | Collier | D8/29 |
| 7,752,946 | B2 | | 7/2010 | Wang | |
| D642,882 | S | * | 8/2011 | Lane | D8/29 |
| 8,069,754 | B2 | | 12/2011 | Elgin | |
| 8,528,450 | B2 | * | 9/2013 | Lan | B25B 13/483 81/125 |
| 2007/0227311 | A1 | | 10/2007 | Wang | |
| 2008/0121073 | A1 | | 5/2008 | Williams | |
| 2011/0296961 | A1 | * | 12/2011 | Ortiz | 81/124.1 |

* cited by examiner

*Primary Examiner* — Joseph J Hail
*Assistant Examiner* — Marc Carlson
(74) *Attorney, Agent, or Firm* — Michael Best & Friedrich LLP

(57) ABSTRACT

A socket includes a body having first and second ends and defining a longitudinal axis, a receptacle formed in the first end of the body, and an aperture in the body positioned between the first and second ends. An interior of the receptacle is visible through the aperture from a location exterior of the socket.

13 Claims, 5 Drawing Sheets

SOCKET

CROSS-REFERENCE TO RELATED APPLICATIONS

This application claims priority to U.S. Provisional Patent Application No. 61/609,445 filed Mar. 12, 2012, the entire content of which is incorporated herein by reference.

FIELD OF THE INVENTION

The present invention relates to hand tools, and more particularly to sockets.

BACKGROUND OF THE INVENTION

Sockets are typically utilized with ratcheting socket wrenches for tightening and/or loosening fasteners that are configured to be received within the socket. Once a fastener is received within a conventional socket, the location of the head of the fastener is not visible from a location exterior of the socket.

SUMMARY OF THE INVENTION

The invention provides, in one aspect, a socket including a body having first and second ends and defining a longitudinal axis, a receptacle formed in the first end of the body, and an aperture in the body positioned between the first and second ends. An interior of the receptacle is visible through the aperture from a location exterior of the socket.

Other features and aspects of the invention will become apparent by consideration of the following detailed description and accompanying drawings.

DETAILED DESCRIPTION

Figure 1:
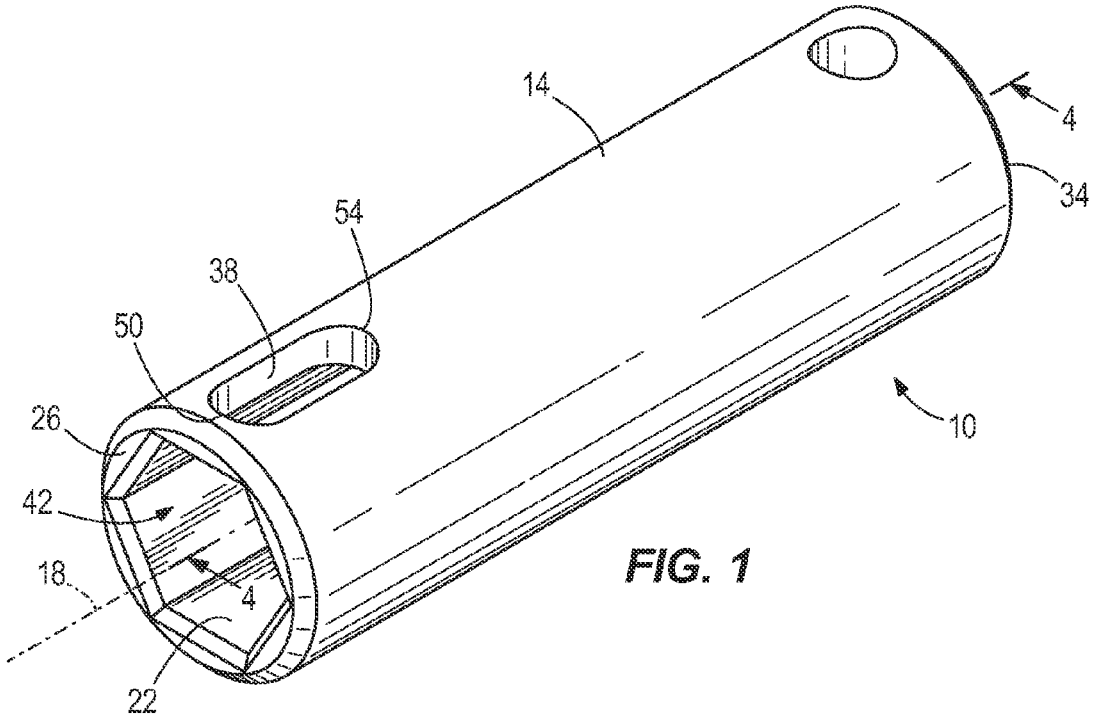
FIG. 1 is a front perspective view of a socket in accordance with an embodiment of the invention.
Figure 2:
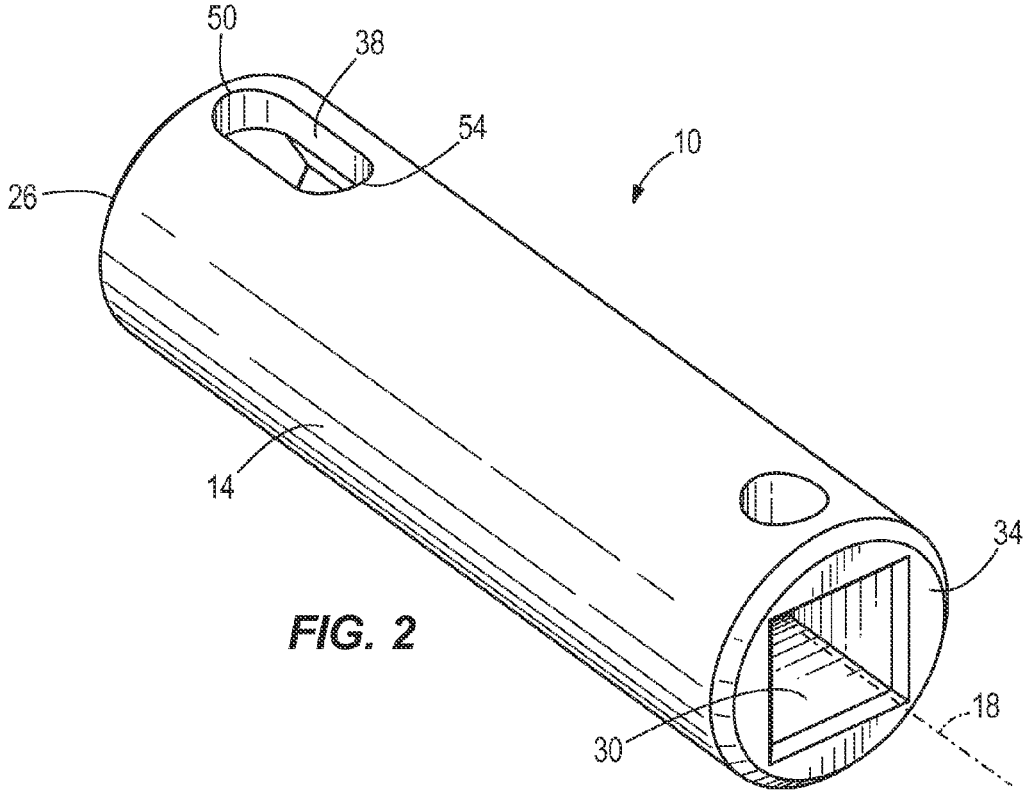
FIG. 2 is a rear perspective view of the socket of FIG. 1.

With reference to FIGS. 1 and 2, a socket 10 in accordance with an embodiment of the invention includes a cylindrical body 14 defining a longitudinal axis 18. A first receptacle 22 (FIG. 1) is formed in a first end 26 of the body 14, and a second receptacle 30 (FIG. 2) is formed in a second end 34 of the body 14. In the illustrated embodiment of the socket 10 shown in FIG. 1, the first receptacle 22 includes a hexagonal cross-sectional shape for receiving heads of fasteners having a corresponding cross-sectional shape. Alternatively, the first receptacle 22 may be defined by twelve surfaces spanning the periphery of the first receptacle 22. Such a configuration is otherwise known as a "twelve-point" socket configuration for receiving fastener heads having either a hexagonal cross-sectional shape or a twelve-point fastener head. As a further alternative, the first receptacle 22 may include any of a number of different cross-sectional shapes for receiving corresponding shaped fastener heads.

With reference to FIG. 2, the second receptacle 30 includes a square cross-sectional shape. Although not shown, a square head of a ratcheting socket wrench is receivable within the second receptacle 30 for driving the socket 10 in a clockwise or counter-clockwise direction with respect to a workpiece.

Figure 3:
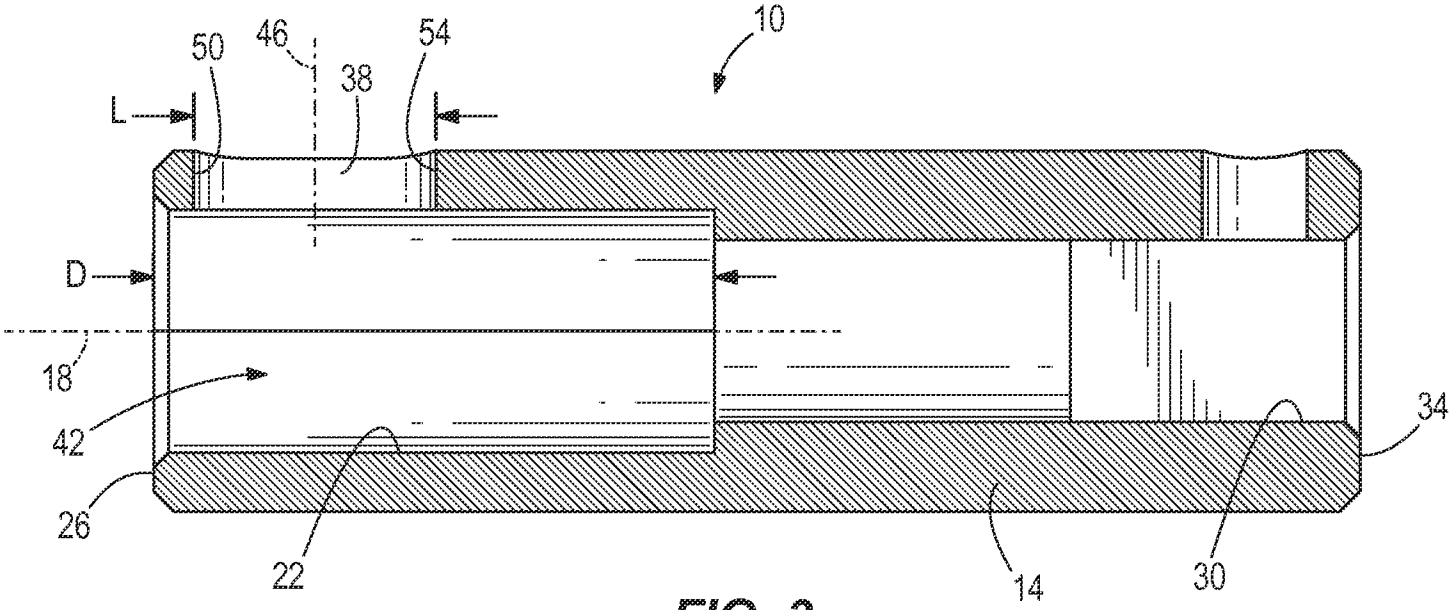
FIG. 3 is a cross-sectional view of the socket of FIG. 1.

With reference to FIGS. 1-3, the socket 10 also includes an aperture 38 in the body 14 positioned between the first and second ends 26, 34. The aperture 38 is adjacent the first end 26 of the body 14 such that an interior 42 of the first receptacle 22 is visible through the aperture 38 from a location exterior of the socket 10. In the illustrated embodiment of the socket 10, the aperture 38 is elongated in a direction of the longitudinal axis 18. Specifically, the aperture 38 includes an oval shape with a central axis 46 oriented substantially transversely to the longitudinal axis 18 (FIG. 3). Alternatively, the aperture 38 may include any of a number of different elongated shapes. As a further alternative, the aperture 38 may include a shape without distinct major and minor axes.

With continued reference to FIG. 3, the aperture 38 includes a length L oriented parallel to the longitudinal axis 18. The aperture 38 includes first and second sides 50, 54 between which the length L is defined, with the first side 50 being positioned adjacent the first end 26 of the body 14. As such, the head of the fastener is visible through the aperture 38 from a location exterior of the socket 10 when the fastener head is tightened against an underlying workpiece or surface. The length L of the aperture 38 may be at least about 25% of a depth D of the first receptacle 22. Particularly, in the illustrated embodiment of the socket 10, the length L of the aperture 38 is at least about 40% of the depth D of the first receptacle 22. Alternatively, the length L of the aperture 38 may be unrelated to the depth D of the first receptacle 22. As a further alternative, the length L of the aperture 38 may be proportional to the nominal size (i.e., diameter) of the socket 10. In other words, a socket 10 having a large diameter may also have an aperture 38 with a longer length L compared to the aperture 38 in a smaller diameter socket 10.

In use of the socket 10, an individual may view a fastener head through the aperture 38 to determine the relative position of the fastener head within the first receptacle 22. As such, the individual may ascertain whether the fastener has been driven to a proper depth within a workpiece.

Figure 4:
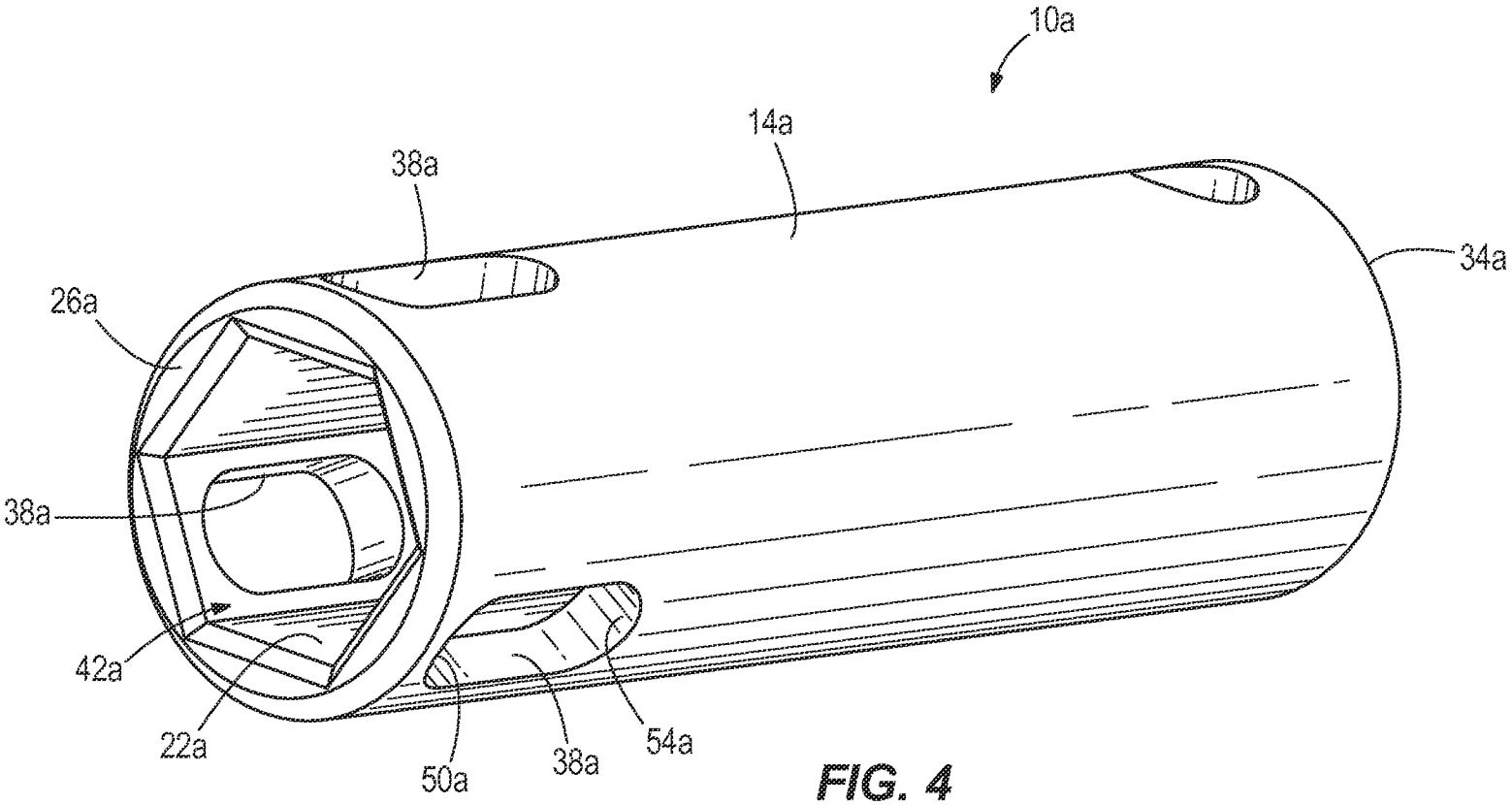
FIG. 4 is a front perspective view of a socket in accordance with yet another embodiment of the invention.

FIG. 4 illustrates a socket 10*a* in accordance with another embodiment of the invention. Like features are identified with like reference numerals with the letter "a." The socket 10*a* includes three apertures 38*a* in the body 14*a* such that the interior 42*a* of the first receptacle 22*a*, and therefore any fastener disposed therein, is visible from three different locations exterior of the socket 10*a*. In the illustrated embodiment of the socket 10*a*, the apertures 38*a* are equally spaced from each other about the periphery of the hexagonal receptacle 22*a* (i.e., at 120 degrees). Alternatively, the socket 10*a* may include more than three apertures 38*a* so that the interior 42*a* of the first receptacle 22*a* is visible from a corresponding number of different locations exterior of the socket 10*a*. Furthermore, the socket 10*a* may include only two apertures 38*a* equally spaced from each other about the periphery of the hexagonal receptacle 22*a* (i.e., at 180 degrees).

Figure 5:
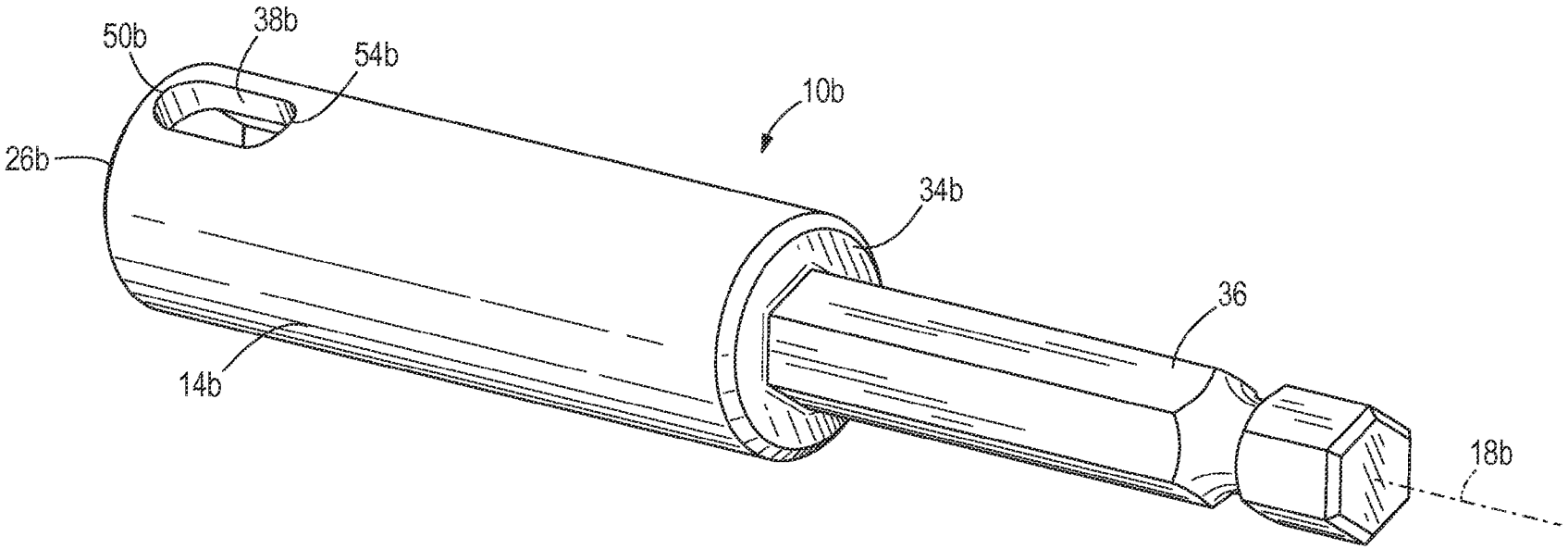
FIG. 5 is a rear perspective view of a socket in accordance with another embodiment of the invention.

FIG. 5 illustrates a socket 10*b* in accordance with yet another embodiment of the invention. Like features are identified with like reference numerals with the letter "b." The socket 10*b* includes a hexagonal shaft 36 extending from the second end 34*b* of the body 14*b*, rather than the second receptacle 30 (FIG. 2) used in connection with the socket 10 of FIGS. 1-3. The hexagonal shaft 36 may be received within a chuck of a drill driver for using the socket 10*b* as a nut or other fastener driver.

Figure 6:
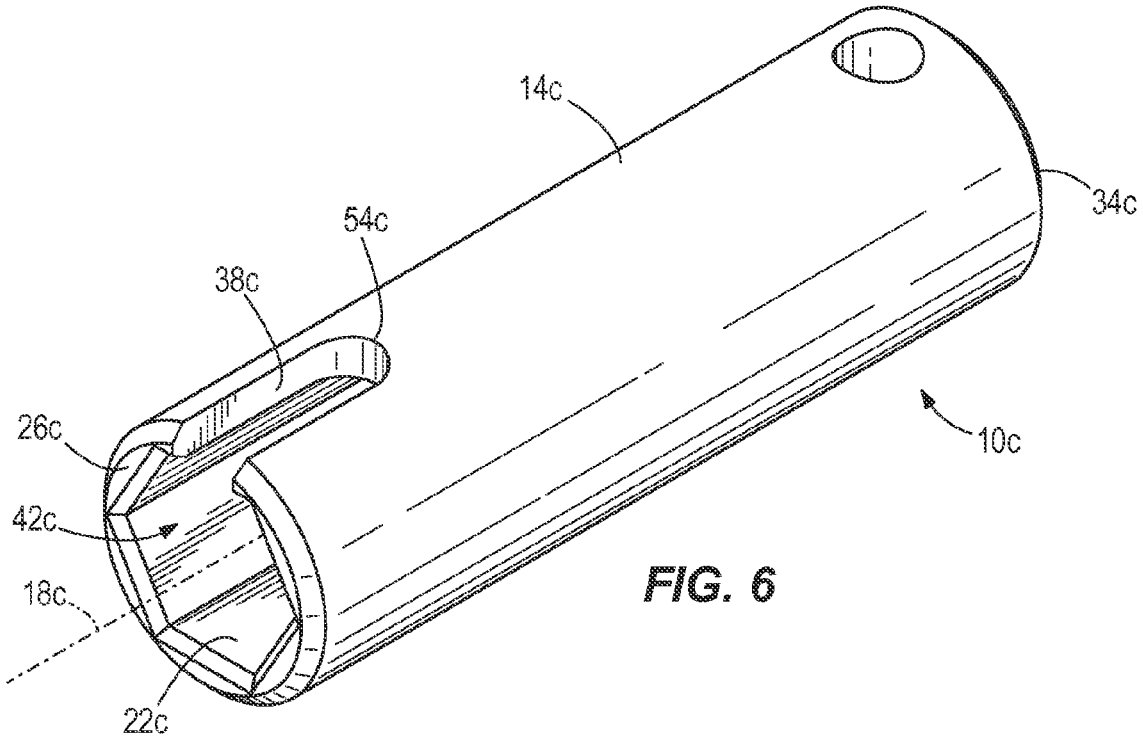
FIG. 6 is a front perspective view of a socket in accordance with yet another embodiment of the invention Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

FIG. 6 illustrates a socket 10*c* in accordance with a further embodiment of the invention. Like features are identified with like reference numerals with the letter "c." The aperture 38*c* extends to the first end 26*c* of the body 14*c*, such that the length of the aperture 38*c* is defined between the first end 26*c* of the body 14*c* and the end 54*c*. Put another way, the aperture 38*c* extends from the first end 26*c* of the body 14*c* and terminates in a single end 54*c*.

Various features of the invention are set forth in the following claims.

What is claimed is:

1. A socket for performing work on a fastener, the socket comprising:

a body having first and second ends and defining a longitudinal axis, the body having an elongated outer sidewall between the first and second ends;

a non-cylindrical receptacle, shaped for receiving the fastener, formed in the first end of the body; and an aperture the through the elongated outer sidewall of the body positioned between the first and second ends, the aperture extending through at least one planar surface of the receptacle, wherein the aperture includes a width oriented transverse to the longitudinal axis and a length oriented parallel to the longitudinal axis and longer than the width, wherein the aperture includes first and second sides between which the length is defined, and wherein the first side is positioned adjacent but not coinciding with the first end of the body, and wherein, in absence of the fastener, the aperture and the receptacle are devoid of any structure to provide an unobstructed view into the receptacle through the aperture, anywhere along the length of the aperture.

2. The socket of claim 1, wherein the aperture is elongated in a direction of the longitudinal axis.

3. The socket of claim 1, wherein the aperture includes an oval shape.

4. The socket of claim 1, wherein the length of the aperture is at least about 25% of a depth of the receptacle.

5. The socket of claim 1, wherein the length of the aperture is at least about 40% of a depth of the receptacle.

6. The socket of claim 1, wherein the receptacle is defined by at least six surfaces each having a length oriented in a direction of the longitudinal axis.

7. The socket of claim 1, wherein the receptacle includes a hexagonal cross-sectional shape.

8. The socket of claim 1, wherein the receptacle is a first receptacle, and wherein the socket further includes a second receptacle formed in the second end of the body.

9. The socket of claim 8, wherein the second receptacle includes a square cross-sectional shape, and wherein a square head of a socket wrench is receivable within the second receptacle for driving the socket.

10. The socket of claim 1, further comprising a shaft extending from the second end of the body.

11. The socket of claim 10, wherein the shaft includes a hexagonal cross-sectional shape.

12. The socket of claim 1, wherein the aperture includes a central axis oriented substantially transversely to the longitudinal axis.

13. The socket of claim 1, wherein the aperture is a first aperture, and wherein the socket further includes a second aperture in the body positioned between the first and second ends.

* * * * *